United States Patent [19]

Manor

[11] Patent Number: 4,759,658

[45] Date of Patent: Jul. 26, 1988

[54] CONCRETE FINISHING BROOM

[76] Inventor: Jonathan W. Manor, R.R. #2, Box 49, Albany, Ind. 47320

[21] Appl. No.: 936,119

[22] Filed: Dec. 1, 1986

[51] Int. Cl.[4] ..... E01C 19/44

[52] U.S. Cl. ..... 404/93; 15/222

[58] Field of Search ..... 404/83, 93, 101, 118, 404/119; 15/222; 114/222

[56] References Cited

U.S. PATENT DOCUMENTS

| | | | |
|---|---|---|---|
| 2,285,412 | 6/1942 | Caldwell | 15/222 X |
| 2,902,909 | 9/1959 | Reissinger | 404/118 |
| 2,962,946 | 12/1960 | Neff | 404/101 |
| 3,596,578 | 8/1971 | Jones | 404/93 |
| 4,318,631 | 3/1982 | Vickers | 404/93 |

FOREIGN PATENT DOCUMENTS

| | | | |
|---|---|---|---|
| 18830 | of 1912 | United Kingdom | 114/222 |

*Primary Examiner*—Jerome Massie, IV
*Assistant Examiner*—Matthew Smith
*Attorney, Agent, or Firm*—P. Gregory Cross; William E. Shull

[57] ABSTRACT

An apparatus for concrete finishing to be used primarily in application involving large surface areas. A concrete finishing broom is adapted to wire, cable, rope or other means for pulling the broom across the concrete surface. The broom is fitted also with a second cable or similar pulling means, allowing the imposition of an opposing tensional force while it is drawn across the concrete surface for purposes of stability and uniformity in the finishing pattern, as well as to permit the broom to be drawn across the surface in the reverse direction.

5 Claims, 3 Drawing Sheets

CONCRETE FINISHING BROOM

BACKGROUND OF THE INVENTION

The present invention relates to an improved apparatus for finishing concrete surfaces, particularly in applications involving large surface areas.

If concrete is allowed to cure normally without interference, random accumulations of sand, rock or gravel, the principal components of concrete, will be visible on the top surface. For appearance reasons, it is therefore generally considered desirable to subject the poured concrete to a process commonly known as "floating" which ultimately results in the submersion of the solid particulate matter within the mixture, allowing the smoother liquid cement to appear on the surface. A long handled, bladed device, usually made of magnesium or aluminum and referred to as a "float" will accomplish this purpose when drawn across the wet surface. The cement can then be finished to the desired texture and consistency. In concrete construction of a relatively small scale, the finishing process may be accomplished by hand, using well known troweling methods and tools.

In modern construction practice, however, it is commonplace to encounter situations where concrete is poured over much larger areas. Parking garage surfaces, factory or warehouse floors and even slab foundations in residential building construction all involve the placement of large amounts of concrete. Although perfectly smooth concrete surfaces, such as may be found desirable in sidewalks, patios, etc., may not be required in applications such as those described, a consistent pattern in the surface, completely uniform in spacing and appearance is still highly desirable for aesthetic reasons. Obviously hand troweling and similar concrete finishing methods customarily employed in construction projects of smaller size are entirely impractical in tasks of such magnitude.

At the present time there is generally recognized in the prior art only one basic method of finishing large areas of concrete. Familiar push brooms such as are commonly used in sweeping floors are pulled across the drying concrete surface, leaving a pattern formed by the bristles as they pass across. Such brooms will ordinarily be found to possess threaded apertures into which a handle with perhaps one or more extensions may be fitted. This construction permits the broom to be drug across a concrete surface of area comparable to the length of the handle. For practical purposes, however, such a device becomes increasingly unwieldly as the length of the handle is increased, it being the general experience that a workman is unable to guide the broom and achieve consistent finishing at distances much greater than eighteen feet. If a concrete surface that is to be finished has dimensions greater than eighteen feet, therefore, it is necessary that the workmen actually step upon the surface itself in order to reach all areas. The concrete must be in a relatively advanced state of curing to support the worker's weight as he traverses its surface, and accordingly it is often necessary to have a greater number of persons employed in the finishing process than would be the case on smaller jobs. Since many areas of the concrete surface can not feasibly be reached until curing has progressed to a stage allowing a person to walk on it, in order to finish all areas before the concrete has completely cured or "set up", it is mandatory that an adequate number of workers with finishing brooms be utilized. As the brooms are pulled back across the concrete, the worker's footprints are to some extent eradicated by the textured impressions made by the broom itself, but troweling machines are usually required to completely remove such marks. At the same time some workers are pulling finishing brooms across the concrete surface, another person is required to perform edging work, necessitated by inherent physical limitations of the floating devices. At the edge of the concrete surface a gap or a dip may exist, or rocks or other solid matter may be lying on the surface simply because the workman operating the float may not have been able to manipulate the device along the edge due to spatial constraints. Such areas have to be floated and finished by hand, and since often access to many of these areas can not be permitted until the concrete has already cured somewhat, it is usually required that a worker be specifically assigned to perform the edging work while other workers are finishing the concrete with brooms.

As is well known to those knowledgeable in the industry, existing methods for finishing large concrete surfaces possess many disadvantages, not the least of which is the risk that the concrete will completely "set up" or dry before the entire surface can be finished. The only way to insure that all areas of a large concrete floor can be finished in time, recognizing that the concrete must first be cured to a degree allowing a construction worker to step upon the surface itself, is to employ a sufficiently large number of workers, many more than what would be the case if the finishing work could be commenced sooner in the curing process. With a larger number of different workers and a corresponding number of brooms, it is virtually certain that the finished surface will feature varying degrees of consistency and appearance. Even the work performed by one individual will demonstrate marked variations as he or she progresses, as it is extremely difficult for a worker to draw a broom across one section of concrete surface and then repeat the motion on an adjacent section with any degree of uniformity. As there is no guiding mechanism on the device, it is seldom possible to keep the impressions left by the broom as it passes over the concrete in alignment with those made previously.

SUMMARY OF INVENTION

The present invention was developed in an effort to circumvent the disadvantages existing in the methods and devices of the prior art. Instead of extended handles, a concrete finishing broom is adapted to a wire, cable, rope or other means for pulling a broom across large areas of concrete. The need for workers to actually tread upon the surface itself is thereby obviated, allowing the finishing process to be initiated well before the concrete has cured to the extent otherwise necessary. As more time is available to complete the finishing process, the risk of having the concrete set up prematurely is substantially less and as a consequence, the number of workers required can be reduced. It is contemplated that in most situations, only two workers will be required to perform concrete finishing work of the type described no matter how large the subject surface area may be.

The broom is also fitted with a second cable or similar pulling means extending from the broom in an opposite direction from that of the first, allowing a tensional force to be imposed on the broom as it is pulled across the concrete, which together with other features of the device insure a straight consistent texture in the finished surface with proper usage. When a broom has been pulled completely across the entire surface of the concrete, its direction may immediately be reversed without difficulty and with very little effort by the workmen.

Accordingly, it is the object of the invention to provide an improved concrete finishing apparatus that can be employed over large areas without requiring its users to actually tread upon the surface itself.

Another object is to provide such a device that reduces the requisite number of workmen required to finish concrete surfaces of large area, with the accompanying economic advantages caused thereby.

Still another object is to provide such an apparatus which will permit concrete finishing of large surface areas with a consistency, uniformity and appearance not possible with the use of the methods and devices found in the prior art.

Other objects and features of the invention are to found in the following description and claims.

DESCRIPTION OF THE PREFERRED EMBODIMENT

Figure 1:
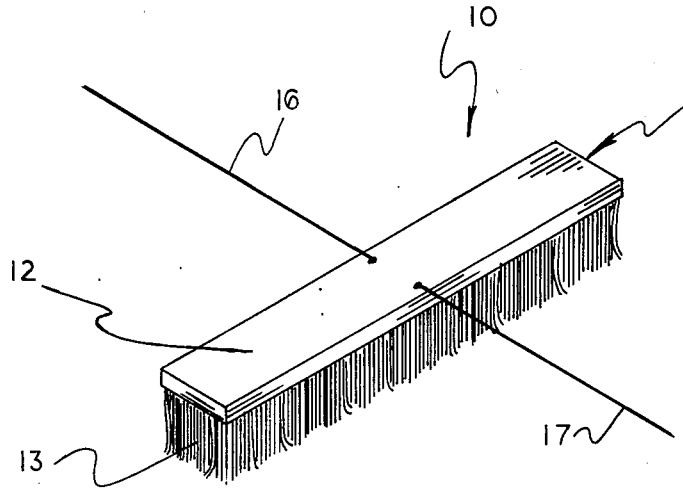
FIG. 1 shows a standard broom with cables attached at each side.

Referring now to FIG. 1, there is pictorially shown a broom apparatus for concrete finishing generally indicated by the number 10. The broom 11 is of standard construction, with a block 12, usually made of wood and rectangular in shape, and a multiplicity of bristles 13 extending downwardly from the block customarily made of plastic or nylon. A first pulling means 16 for manually drawing the broom across the concrete surface to be finished is attached to the block 12 of the broom 11. The first pulling means 16 may be composed of any type of rope, cord, wire or cable as preferred by the user, so long as very minimal strength constraints are met. Use of cables formed of heavier metals such as steel may be more durable, but are likely to be less economical and the sag occasioned by their weight may limit the size of the areas of concrete surface over which the apparatus may be employed to something less than would be the case with the use of lighter materials. Satisfactory results have been accomplished with the use of an ordinary rope, and in the embodiments shown in the drawings, the first pulling means 16 depicted therein are of that substance.

Figure 2:
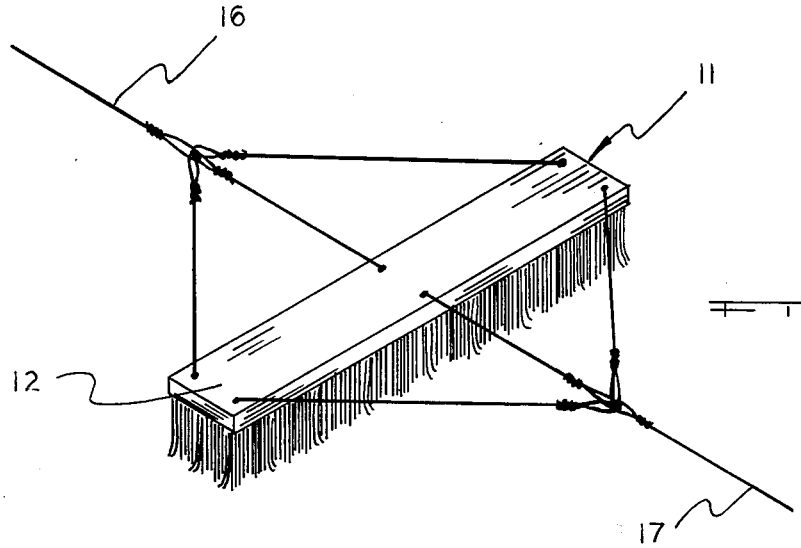
FIG. 2 is a modified form of FIG. 1 additionally showing support cables attached at the broom ends.

Securely attached to the block 12 and located opposite the pulling means 16 is a second pulling means 17 made of the same material. A workman positioned alongside but off of the concrete surface, not shown, draws the broom 11 by pulling the rope 16 towards him across the concrete thereby finishing the cement surface. Another workman situated off of the surface at a point directly opposite the first workman imposes an opposing tensional force on the broom 11 by applying sufficient force on the second rope 17 as to keep it taut. The existence of this opposing force serves to guide the broom 11 as it is brought across the concrete, such that the finished impressions it leaves are straight and relatively uniform. As shown by the example depicted in FIG. 2, both the pulling means 16 and the second pulling means 17 can be attached to the block 12 of the broom at more than one location so as to increase the stability of the broom 11 as it is used in the finishing process.

After the broom 11 has been pulled completely across the top of the concrete, the workman simply lifts it up and sets it back down on the surface immediately adjacent to the strip just completed. The workman formerly applying the opposing tensional force now pulls the device back across the surface towards himself, while the person who had been previously pulling the broom now administers the tensional force. Once the broom has again traversed the concrete surface, completing the finishing process of another strip of width the same as that of the broom, the roles of the workmen are again reversed and the process continued until the entire concrete surface has been completely finished. In practice, use of the apparatus results in a series of nearly uniform strips of finished concrete without the variations in angle, texture and consistency commonly found by the use of hand devices.

As the workmen using this device can operate it from locations alongside but off of the concrete surface, there is no need for them to actually step upon it, and accordingly no need to await the concrete to cure to a point sufficient to allow them to do so before the finishing process is commenced. Finishing of the concrete may begin much earlier in the curing process with the use of the invention than is allowed by employment of devices and methods of the prior art. The danger of the concrete becoming completely cured before the entire surface can be finished is virtually eliminated, and it is contemplated that as a result of the much longer time available to complete finishing, two workmen operating the apparatus as described should alone be able to finish all but the largest of concrete surfaces. At the same time, they will be able to complete the edging work as well, sufficient time being available before the concrete has completely dried to allow them to perform this task as they go along. The workman applying the tensional force to the broom 11 with the rope 17 may even be able to do so with one hand, freeing the other hand to perform the edging work while he awaits his turn to resume the pulling activity. It is seen that by fabricating an apparatus capable of finishing concrete surfaces over large areas without requiring that the workman actually step upon the surface itself, the consequent decrease in the waiting period before the finishing process can begin will result in the corresponding reduction of the number of workmen needed from several to just two in most applications.

Figure 3:
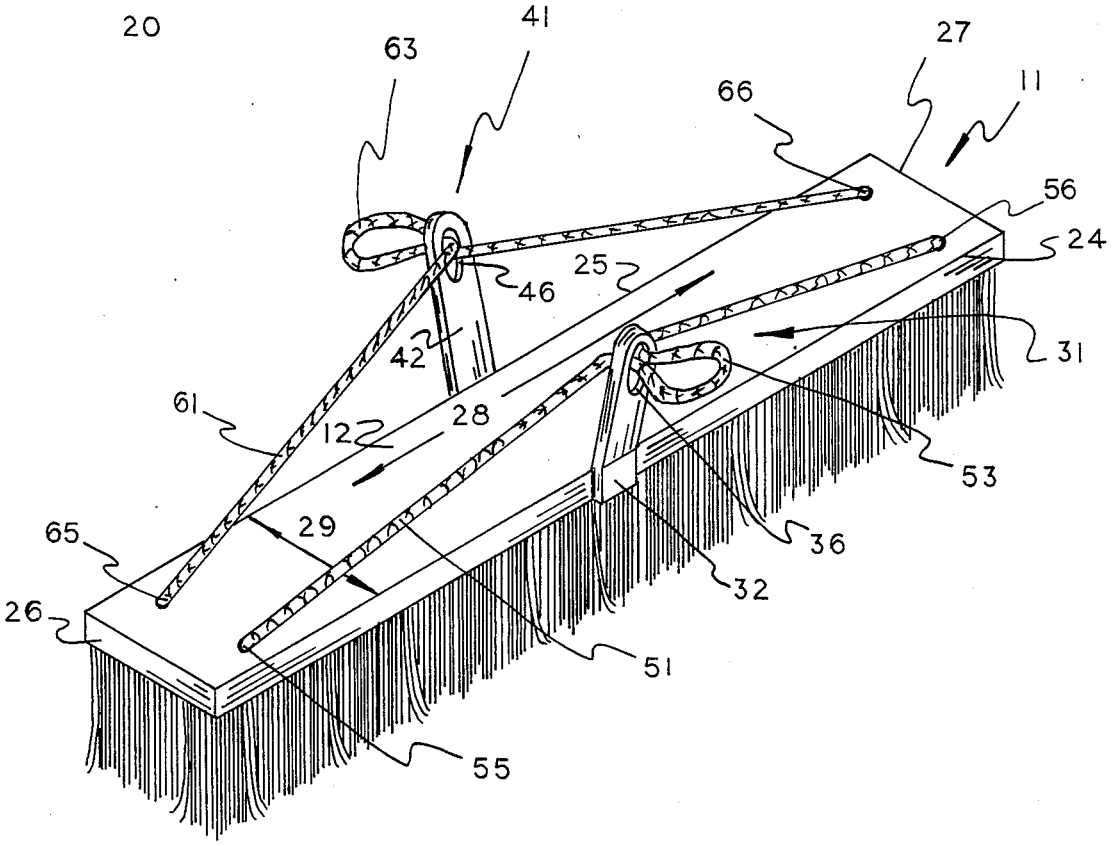
FIG. 3 is an embodiment showing a broom with a modified form of attaching support cables with spacing members.
Figure 4:
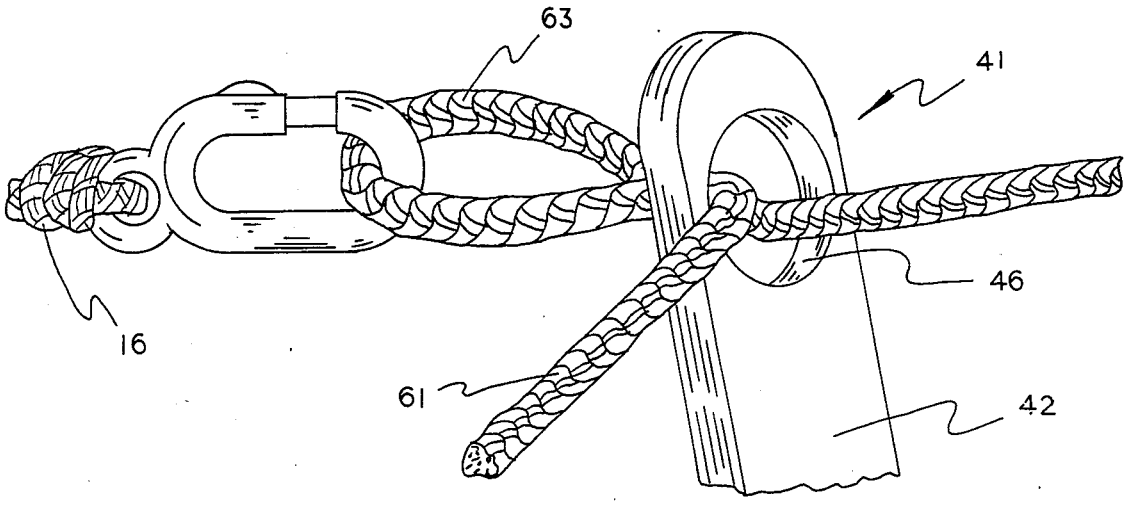
FIG. 4 is an enlarged view of FIG. 3 showing the pulling cable attachment.

Although a number of embodiments of the apparatus described above may be envisioned, all of which are within the scope of the invention as defined by the claims, it has been found that in practice the apparatus performs most effectively with certain modifications, as shown in FIG. 3. Depicted in said figure is an embodiment of the invention indicated generally by the numeral 20, having a first spacing member 31 and a second spacing member 41. One end of each spacing member, 32 and 42, respectively, is rigidly affixed to the block 12 of the broom 11. As shown, the end 32 of spacing member 31 is attached to the block 12 at a point midway along one longitudinal edge 24 and the end 42 of the other spacing member 41 is attached to the block opposite, midway along the other longitudinal edge 25. The spacing members protrude upwardly from the plane of the block 12, and may be positioned at any angle relative to the plane, so long as they are symmetric to each other and perpendicular to the longitudinal axis 28 of the block 12. The spacing members may even be perpendicular to the plane of the block 12, but more stability is achieved if they extend outwardly from the block, with the angle between the spacing members and the upper surface of the block 12 being between 120 and 135 degrees. The unattached ends of both spacing members are supplied with an eye construction 36 and 46. A guiding cable 51 is attached to the block 12 at a point 55 near one of its lateral edges 26 and routed through the eye 36 on the spacing member 31. The guiding cables 51 and 61 may be of rope, wire or strong nylon cord, however best results in terms of durability and performance appear to occur with the use of a lightweight steel cable. As shown in FIG. 4, the cable 51 is routed through the eye 36 so as to form a loop in the cable 53. The remaining end of the guiding cable 51 is attached to the other end of the block 12 at a point 56 in proximity to the block's other lateral edge 27. A second guiding cable 61 is symmetrically attached to the block 12 at a point 65, routed through the eye 46 of the other spacing member 41, as to form a corresponding loop 63. The remaining end of the second guiding cable is similarly attached to the block 23 at a point 66 near its other lateral edge 27. For ease of construction, a pair of eye-bolts or similar hardware (not shown) may be inserted in the block 12 at either end in proximity to the lateral edges 26 or 27 of the block, and the ends of the guiding cables 51 and 61 attached to the eye-bolts instead of directly to the block itself.

The loop 53 thus formed in the guiding cable 51 through the eye 36 of the spacing member 31 provides a connection point for the rope or other pulling means 16 to attach to the broom assembly. Connection of the pulling means 16 to the guiding cable loop 53 can of course be achieved in any one of a number of ways, e.g. the common snap hook shown in FIG. 4, which permits easy disconnection for purposes of cleaning or replacement. A similar connection is made by the second pulling means 17 with the loop 63 in the second guiding cable 61. In practice, use of the embodiment just described results in a steadier pattern in the finished concrete than is the case in more simplified versions. The force exerted on the broom 11 by the pulling means 16 and 17 is distributed across the entire broom 11, helping to assure a steady, even traverse across the concrete surface.

Figure 5:
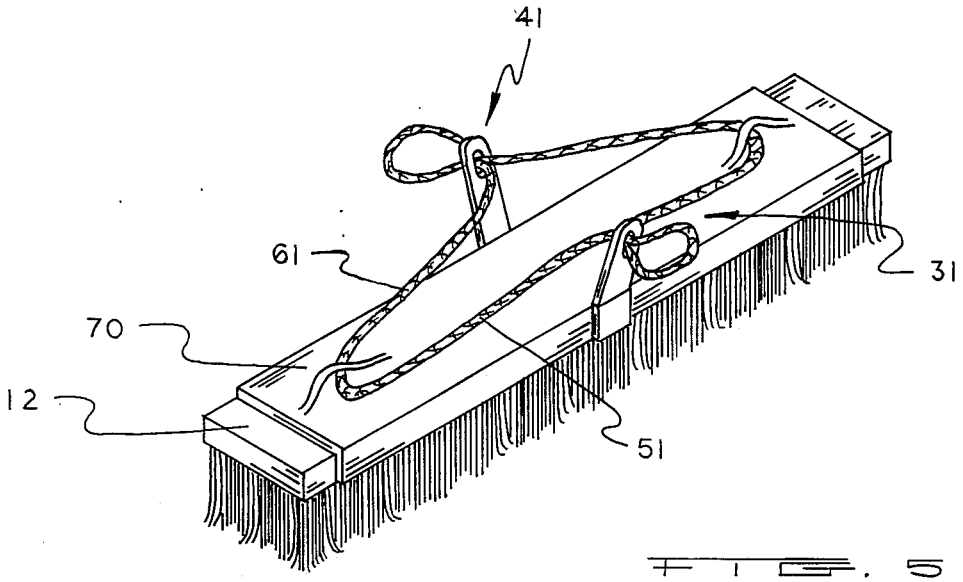
FIG. 5 shows another embodiment having a removable frame.

FIG. 5 shows yet another embodiment of the device wherein a removeable metal frame 70 is secured to the block 12. The spacing members 31 and 41 are in this modification attached to the frame as are the guiding cables 51 and 61. Brooms used in the process of concrete finishing naturally experience a great deal of wear and tear and will upon occasion need to be replaced. Additionally, if a workman fails to clean the broom carefully after use, concrete material picked up by the bristles as the broom is drawn across the concrete surface will dry out, ruining the broom. The modification of the invention shown in FIG. 5 permits the easy replacement of old or ruined brooms. By constructing the apparatus with a frame that can either be slid or clamped over the block 12 in some fashion, only the defective broom need be discarded in such circumstances.

I claim:

1. An apparatus for finishing a concrete surface, comprising:

a broom, having a block with two lateral edges and two longitudinal edges and an upper surface, and a multiplicity of bristles attached to said block and extending downwardly therefrom, a first spacing member, one end being rigidly fixed to the block of said broom at a point in the center of one of the longitudinal edges of said block, said first spacing member having an eye at its opposite end, and extending upwardly from the block of said broom perpendicular to its longitudinal axis, a second spacing member, one end being rigidly fixed to the block of said broom at a point in the center of the other longitudinal edge of said block, said second spacing member also having an eye at its opposite end, and extending upwardly from the block of said broom perpendicular to its longitudinal axis, a first means for pulling said broom across the concrete surface, a second means for pulling said broom across the concrete surface in a reverse direction from that of said first means, a first guiding cable having one end affixed to the block of said broom at a point near one lateral edge, extending through the eye positioned on the end of said first spacing member, forming a loop and then passing back through the eye positioned on the end of said first spacing member, with the remaining end of said first guiding cable being affixed to the block of said broom at a point near the remaining lateral edge, and a second guiding cable having one end affixed to the block of said broom near one lateral edge, extending through the eye positioned on the end of said second spacing member, forming a loop and then passing back through the eye positioned in the end of said second spacing member, with the remaining end of said second guiding cable being affixed to the block of said broom at a point located near the remaining lateral edge, said first means for pulling said broom being connected to the loop in one of said guiding cables formed through the eye positioned on the end of one of said spacing members, and said second means for pulling said broom being connected to the loop in the other of said guiding cables formed through the eye positioned on the end of the other said spacing member.

2. An apparatus for finishing a concrete surface according to claim 1, wherein said first and second spacing members extend outwardly from the block of said broom, the angle formed by said spacing members and the upper surface of said block being between 120 and 135 degrees.

3. An apparatus for finishing a concrete surface according to claim 1, wherein said first means for pulling said broom across the concrete surface comprises a cable, attached to said broom and extending outwardly therefrom, so as to cause said broom to be drawn across the surface to be finished when pulled, and wherein said second means for pulling said broom across the concrete surface comprises a second cable, attached to said broom and extending outwardly therefrom in the opposite direction from said first cable, so that said broom is stabilized as it is being drawn across the surface to be finished, said second cable being disposed so as to enable said broom to be pulled back across the surface to be finished in the reverse direction, when said broom has completed its original traverse thereof.

4. An apparatus for finishing a concrete surface comprising:

a broom, having a block with two lateral edges and two longitudinal edges, and a multiplicity of bristles attached to said block and extending downwardly therefrom, a removable frame, slideably disposed over said block, a first spacing member, one end being rigidly fixed to said frame at a point in the center of one of the longitudinal edges of said frame, said first spacing member having an eye at its opposite end, and extending upwardly from said frame perpendicular to its longitudinal axis, a second spacing member, one end being rigidly fixed to said frame at a point in the center of the other longitudinal edge of said frame, said second spacing member having an eye at its opposite end, and extending upwardly from said frame perpendicular to its longitudinal axis, a first means for pulling said broom across the concrete surface, a second means for pulling said broom across the concrete surface in a reverse direction from that of said first means, a first guiding cable having one end affixed to said frame at a point near one lateral edge, extending through the eye positioned on the end of said first spacing member, forming a loop and then passing back through the eye positioned on the end of said first spacing member, with the remaining end of said guiding cable being affixed to said frame at a point near the remaining lateral edge, and a second guiding cable having one end affixed to said frame near one lateral edge, extending through the eye positioned on the end of said second spacing member, forming a loop and then passing back through the eye positioned in the end of said second spacing member, with the remaining end of said second guiding cable being affixed to said frame at a point located near the remaining lateral edge, said first means for pulling said broom being connected to the loop in one of said guiding cables formed through the eye positioned on the end of one of said spacing members, and said second means for pulling said broom being connected to the loop in the other of said guiding cables formed through the eye positioned on the end of the other said spacing member.

5. An apparatus for finishing a concrete surface according to claim 4, wherein said first means for pulling said broom across the concrete surface comprises a cable, attached to said broom and extending outwardly therefrom, so as to cause said broom to be drawn across the surface to be finished when pulled, and wherein said second means for pulling said broom across the concrete surface comprises a second cable, attached to said broom and extending outwardly therefrom in the opposite direction from said first cable, so that said broom is stabilized as it is being drawn across the surface to be finished, said second cable being disposed so as to enable said broom to be pulled back across the surface to be finished in the reverse direction, when said broom has completed its original traverse thereof.

* * * * *